US010549529B2

(12) United States Patent
Takamura et al.

(10) Patent No.: US 10,549,529 B2
(45) Date of Patent: Feb. 4, 2020

(54) DRIVING DEVICE AND INKJET RECORDING APPARATUS

(71) Applicant: TOSHIBA TEC KABUSHIKI KAISHA, Tokyo (JP)

(72) Inventors: Jun Takamura, Mishima Shizuoka (JP); Yasuhito Komai, Mishima Shizuoka (JP); Takanori Gomi, Numazu Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/997,927

(22) Filed: Jun. 5, 2018

(65) Prior Publication Data

US 2018/0345661 A1 Dec. 6, 2018

(30) Foreign Application Priority Data

Jun. 6, 2017 (JP) ..... 2017-111742

(51) Int. Cl.
*B41J 2/045* (2006.01)
*B41J 2/14* (2006.01)

(52) U.S. Cl.
CPC ..... *B41J 2/04516* (2013.01); *B41J 2/04541* (2013.01); *B41J 2/04581* (2013.01); *B41J 2/04596* (2013.01)

(58) Field of Classification Search
CPC ..... B41J 2/04516
See application file for complete search history.

(56) References Cited

U.S. PATENT DOCUMENTS

| | | | | |
|---|---|---|---|---|
| 6,464,315 | B1 | 10/2002 | Otokita et al. | |
| 6,899,409 | B2 * | 5/2005 | Kusunoki | B41J 2/04581 347/11 |
| 8,632,151 | B2 | 1/2014 | Nishikawa | |
| 9,205,647 | B2 | 12/2015 | Ichikawa | |
| 2005/0024400 | A1 * | 2/2005 | Satake | B41J 2/04581 347/9 |
| 2006/0125856 | A1 | 6/2006 | Kitami et al. | |
| 2007/0030297 | A1 | 2/2007 | Norigoe | |
| 2010/0328381 | A1 | 12/2010 | Kuki et al. | |
| 2014/0160193 | A1 * | 6/2014 | Iwata | B41J 2/04516 347/10 |

(Continued)

FOREIGN PATENT DOCUMENTS

| | | |
|---|---|---|
| EP | 2275264 A1 | 1/2011 |
| EP | 3115211 A1 | 1/2017 |

(Continued)

OTHER PUBLICATIONS

Extended European Search Report dated Oct. 18, 2018, mailed in counterpart European Application No. 18176094.3, 12 pages.

*Primary Examiner* — Shelby L Fidler
(74) *Attorney, Agent, or Firm* — Kim & Stewart LLP

(57) ABSTRACT

According to one embodiment, a driving device includes a head driver configured to generate and apply a driving signal to an actuator for ejecting a liquid from a pressure chamber connected to a nozzle, the driving signal including a contraction pulse, the contraction pulse causing the actuator to contract a volume of the pressure chamber, and end application of the contraction pulse when a flow rate of the liquid from the nozzle has a negative value in a liquid ejection direction from the nozzle.

11 Claims, 12 Drawing Sheets

(56) References Cited

U.S. PATENT DOCUMENTS

| | | | | |
|---|---|---|---|---|
| 2016/0082722 | A1* | 3/2016 | Nitta | B41J 2/04541 347/11 |
| 2017/0008280 | A1* | 1/2017 | Nitta | B41J 2/04541 |
| 2017/0066236 | A1 | 3/2017 | Sohgawa et al. | |
| 2017/0259564 | A1 | 9/2017 | Nitta et al. | |
| 2018/0272707 | A1 | 9/2018 | Nitta | |

FOREIGN PATENT DOCUMENTS

| | | | |
|---|---|---|---|
| EP | 3378650 | A1 | 9/2018 |
| JP | 2004-202707 | A | 7/2004 |
| JP | 2013-199065 | A | 10/2013 |

* cited by examiner

DRIVING DEVICE AND INKJET RECORDING APPARATUS

CROSS-REFERENCE TO RELATED APPLICATION

This application is based upon and claims the benefit of priority from Japanese Patent Application No. 2017-111742, filed Jun. 6, 2017, the entire contents of which are incorporated herein by reference.

FIELD

Embodiments described herein relate generally to a driving device and an ink jet recording apparatus.

BACKGROUND

Inkjet printers eject ink droplets from a nozzle of an inkjet head. Upon exiting the nozzle, the ink droplet may separate into several smaller droplets. In particular, after ejection the ink droplet may separate into a main droplet with several smaller droplets in proximity. These smaller droplets are referred to as satellite droplets. These satellite droplets may deteriorate the print quality of images formed by the inkjet printer or the like.

DETAILED DESCRIPTION

In general, according to one embodiment, a driving device includes a head driver configured to generate and apply a driving signal to an actuator for ejecting a liquid from a pressure chamber connected to a nozzle, the driving signal including a contraction pulse, the contraction pulse causing the actuator to contract a volume of the pressure chamber, and end application of the contraction pulse when a flow rate of the liquid from the nozzle has a negative value in a liquid ejection direction from the nozzle.

Hereinafter, an inkjet recording apparatus according to example embodiments will be described with reference to the drawings. It should be noted that the drawings are schematic and are drawn with exaggeration and omissions for purposes of explanatory convenience. In general, components are not drawn to scale. In addition, the number of components, the dimensional ratio between different components, or the like, does not necessarily match between different drawings or to actual devices.

First Embodiment

Hereinafter, a configuration of an inkjet recording apparatus according to a first embodiment will be described.

Figure 1:
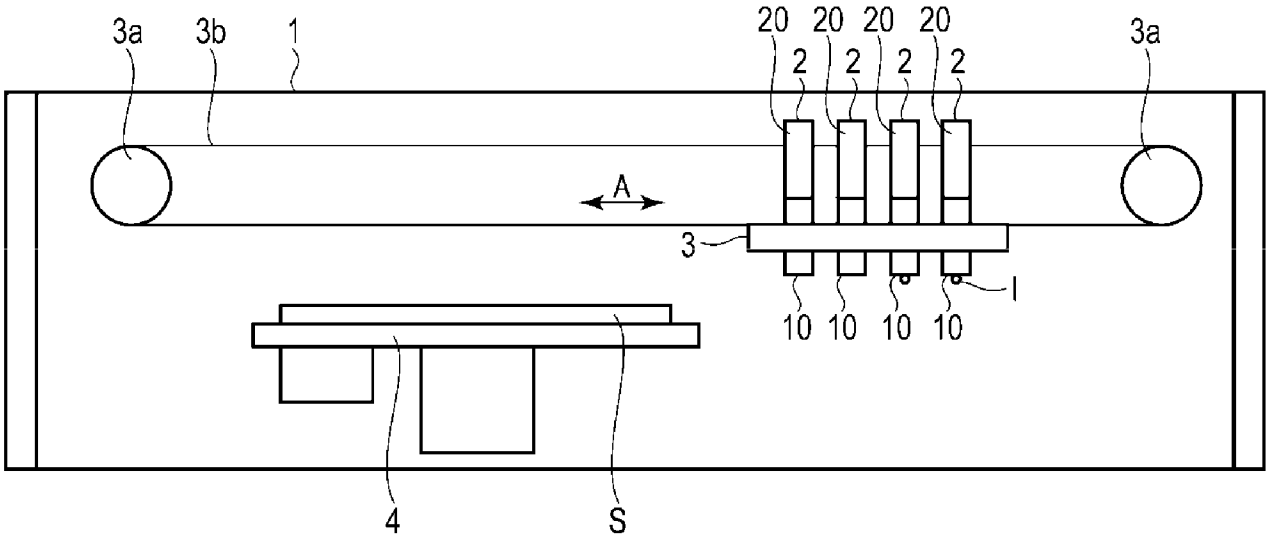
FIG. 1 is a schematic side view illustrating an example of a configuration of an inkjet recording apparatus according to first to fourth embodiments.

FIG. 1 is a schematic side view illustrating an example of a configuration of an inkjet recording apparatus 1 according to the first embodiment.

The inkjet recording apparatus 1 includes, for example, liquid ejectors 2, a head support mechanism 3 that supports the liquid ejectors 2 to be movable, and a medium support mechanism 4 that supports a recording medium S to be movable. The recording medium S is, for example, a sheet made of paper, a resin, or the like.

As illustrated in FIG. 1, the liquid ejectors 2 are supported by the head support mechanism 3 and disposed in a line along a predetermined direction. The head support mechanism 3 is mounted on a loop-shaped belt 3*b* suspended on a pair of roller 3*a*. In the inkjet recording apparatus 1, the head support mechanism 3 can be moved in a main scanning direction A perpendicular to a transport direction of the recording medium S by rotating the rollers 3*a*. The liquid ejector 2 includes an integrated inkjet head 10 and a circulation device 20. The liquid ejector 2 performs an operation of ejecting, for example, ink I as a liquid from the inkjet head 10. The inkjet recording apparatus 1 may form a desired image on the recording medium S, by ejecting ink while reciprocating the head support mechanism 3 in the main scanning direction A (referred to as a scanning scheme). Alternatively, the inkjet recording apparatus 1 may form an image without moving the head support mechanism 3 in the main scanning direction A (referred to as a single pass scheme). In the single pass scheme, the rollers 3*a* and the loop-shaped belt 3*b* may not be provided and the head support mechanism 3 is fixed to the casing or the like of the inkjet recording apparatus 1.

The liquid ejectors 2 each eject, for example, ink of four colors corresponding to CMYK, that is, cyan ink, magenta ink, yellow ink, and black ink, respectively.

Hereinafter, the inkjet head 10 will be described with reference to FIGS. 2 to 4. In the example embodiments described herein, the inkjet head 10 is a circulation type side shooter inkjet head. However, the types of the inkjet head 10 are not limited.

Figure 2:
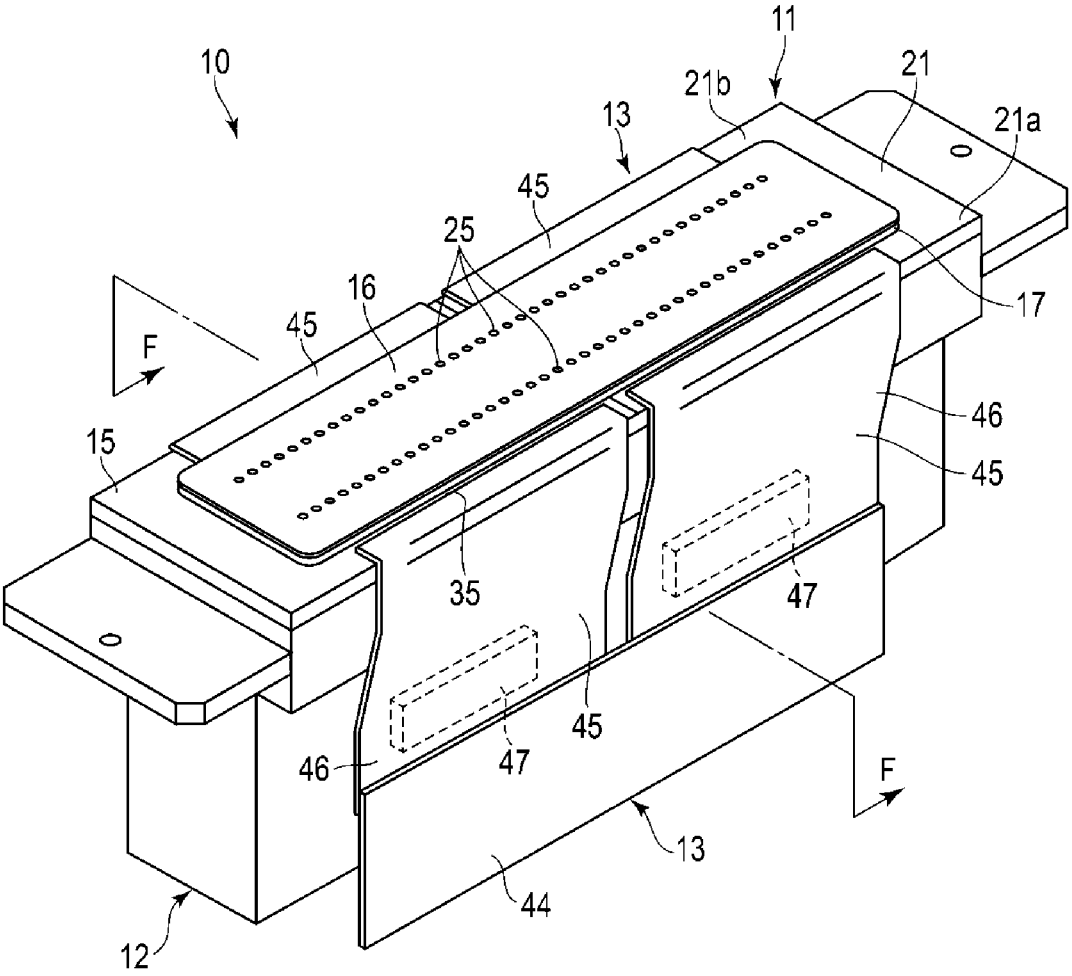
FIG. 2 is a schematic perspective view illustrating an example of a configuration of a liquid ejection head illustrated in FIG. 1.

FIG. 2 is a perspective view illustrating an example of a configuration of the inkjet head 10. FIG. 3 is an exploded perspective view illustrating the configuration of the inkjet head 10. FIG. 4 is a schematic cross-sectional view taken along the line IV-IV of FIG. 2.

The inkjet head 10 is mounted on the inkjet recording apparatus 1 and is connected to an ink tank via a component such as a tube. The inkjet head 10 includes a head body 11, a main body 12, and a pair of circuit substrates 13. In this context, the inkjet head 10 is a driving device. The head body 11 ejects ink. The head body 11 is mounted on the main body 12. The main body 12 includes a manifold that forms a part of an ink flow path between the head body 11 and the ink tank or other elements inside the inkjet recording apparatus 1. The circuit substrates 13 are mounted on the head body 11.

Figure 3:
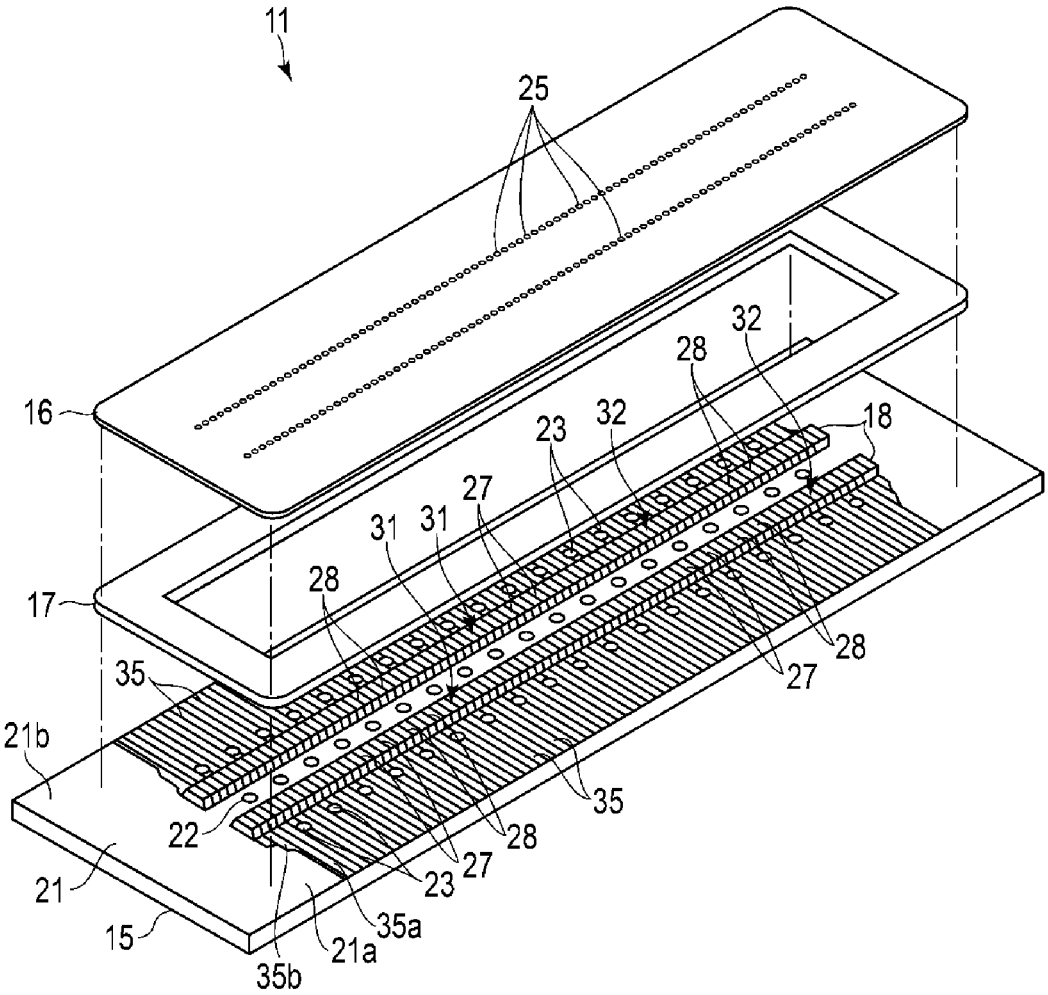
FIG. 3 is a schematic exploded perspective view illustrating the configuration of the liquid ejection head illustrated in FIG. 1.
Figure 4:
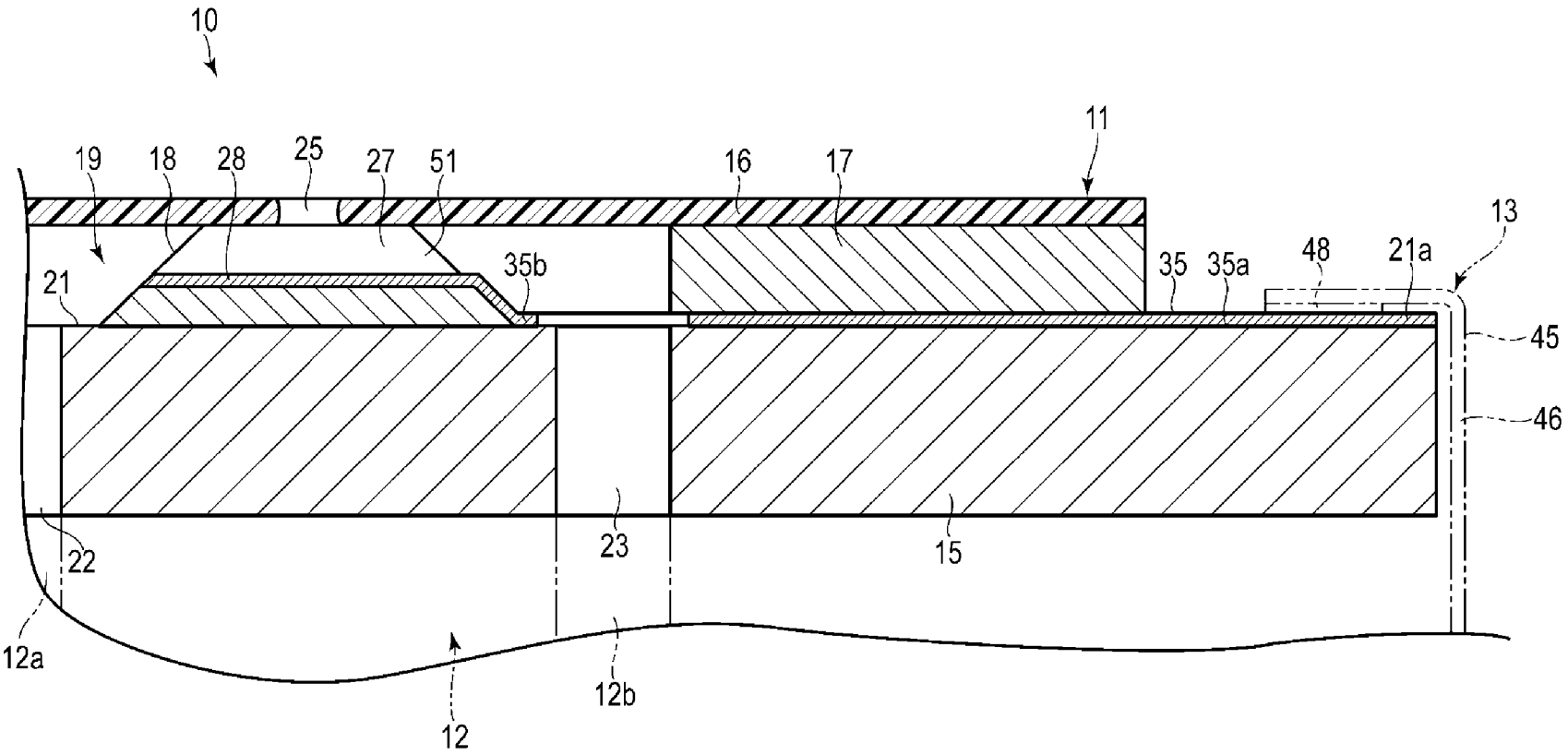
FIG. 4 is a schematic cross-sectional view taken along the line IV-IV of FIG. 2.

The head body 11 includes a base plate 15, a nozzle plate 16, and a frame 17, and a pair of driving elements 18, as illustrated in FIGS. 3 and 4. Inside the head body 11, as illustrated in FIG. 4, an ink chamber 19 to which the ink is supplied is formed.

The base plate 15 is formed of, for example, ceramics such as alumina in a plate shape, as illustrated in FIG. 3. The base plate 15 has a flat mounting surface 21. In the base plate 15, supply holes 22 and of discharge holes 23 are opened on the mounting surface 21.

The supply holes 22 are formed in a line in the longitudinal direction of the base plate 15 in a middle portion of the base plate 15. The supply holes 22 communicate with an ink supply portion 12*a* of the manifold of the main body 12. The supply holes 22 are connected to the ink tank inside the circulation device 20 via the ink supply portion 12*a*. The ink in the ink tank is supplied to the ink chamber 19 via the ink supply portion and the supply holes 22.

The discharge holes 23 are formed in two lines and the supply holes 22 are interposed between the two lines. The discharge holes 23 communicate with an ink discharge portion 12*b* of the manifold of the main body 12. The discharge holes 23 are connected to the ink tank inside the circulation device 20 via the ink discharge portion 12*b*. The ink in the ink chamber 19 is collected to the ink tank via the ink discharge portion 12*b* and the discharge holes 23. In this way, the ink is circulated between the ink tank and the ink chamber 19.

The nozzle plate 16 is formed of, for example, a rectangular film made of polyimide, a surface of which is liquid-repellent. The nozzle plate 16 faces the mounting surface 21 of the base plate 15. In the nozzle plate 16, nozzles 25 are formed. The nozzles 25 are formed in two lines in the longitudinal direction of the nozzle plate 16.

The frame 17 is formed of, for example, a nickel alloy in a rectangular frame shape. The frame 17 is interposed between the mounting surface 21 of the base plate 15 and the nozzle plate 16. The frame 17 is adhered to the mounting surface 21 and the nozzle plate 16. That is, the nozzle plate 16 is mounted on the base plate 15 via the frame 17. As illustrated in FIG. 4, the ink chamber 19 is surrounded by the base plate 15, the nozzle plate 16, and the frame 17.

The driving element 18 is formed by two piezoelectric substances with a plate shape formed of, for example, lead zirconate titanate (PZT). The two piezoelectric substances are bonded so that polarization directions are reverse to each other in the thickness direction.

The pair of driving elements 18 is adhered to the mounting surface 21 of the base plate 15, as illustrated in FIG. 3. The pair of driving elements 18 is disposed inside the ink chamber 19 parallel to the lines of the nozzles 25, as illustrated in FIG. 4. The cross section of the driving element 18 is formed in a trapezoidal shape. The apex of the driving element 18 is adhered to the nozzle plate 16.

Grooves 27 are formed in the driving element 18. The grooves 27 extend in a direction interesting the longitudinal direction of the driving elements 18 and are arranged in the longitudinal direction of the driving elements 18. The grooves 27 face the nozzles 25 of the nozzle plate 16. As illustrated in FIG. 4, pressure chambers 51 are disposed in the driving elements 18 and serve as driving flow paths through which the ink is ejected to the grooves 27.

An electrode 28 is formed in each of the grooves 27. The electrodes 28 are formed, for example, by performing a photoresist etching process on a nickel thin film. The electrodes 28 cover the inner surfaces of the grooves 27.

As illustrated in FIG. 3, wiring patterns 35 are formed across the driving elements 18 on the mounting surface 21 of the base plate 15. The wiring patterns 35 are formed, for example, by performing a photoresist etching process on a nickel thin film.

The wiring patterns 35 extend from one side end 21*a* and the other side end 21*b* of the mounting surface 21. The side ends 21*a* and 21*b* include not only edges of the mounting surface 21 but also regions of the peripheries of the edges. Therefore, the wiring patterns 35 may be formed inner sides of the edges of the mounting surface 21.

In the example embodiments described hereinafter, the wiring patterns 35 extend from the one side end 21*a*. A basic configuration of the wiring patterns 35 of the other side end 21*b* is the same as that of the wiring patterns 35 of the one side end 21*a*.

As illustrated in FIGS. 3 and 4, the wiring pattern 35 includes a first portion 35*a* and a second portion 35*b*. The first portion 35*a* of the wiring pattern 35 is a portion extending in a straight line shape from the one side end 21*a* of the mounting surface 21 to the driving element 18. The first portions 35*a* extend in parallel. The second portion 35*b* of the wiring pattern 35 is a portion astride an end of the first portion 35*a* and the electrode 28. The second portions 35*b* are electrically connected to the electrodes 28, respectively.

In one driving element 18, several electrodes 28 among the electrodes 28 form a first electrode group 31. Other several electrodes 28 among the electrodes 28 form a second electrode group 32.

The first electrode group 31 and the second electrode group 32 are partitioned along a boundary which is the middle portion of the driving elements 18 in the longitudinal direction. The second electrode group 32 is adjacent to the first electrode group 31. Each of the first electrode group 31 and the second electrode group 32 include, for example, 159 electrodes 28.

As illustrated in FIG. 2, each of the pair of circuit substrates 13 includes a substrate body 44 and a pair of film carrier packages (FCP) 45. The FCP is also referred to as a tape carrier package (TCP).

The substrate body 44 is a rigid printed wiring board formed in a rectangular shape. Various electronic components and connectors are mounted on the substrate body 44. The pair of FCPs 45 is each mounted on the substrate body 44.

The pair of FCPs 45 each include a film 46 formed of a flexible resin in which wirings are formed and a head driving circuit 47 connected to the wirings. The film 46 is a tape automated bonding (TAB). The head driving circuit 47 is an integrated circuit (IC) that applies a voltage to the electrodes 28. The head driving circuit 47 is fixed to the film 46 by a resin.

The end of one FCP 45 is thermally pressed to be connected to the first portion 35*a* of the wiring pattern 35 by an anisotropic conductive film (ACF) 48. Thus, the wirings of the FCP 45 are electrically connected to the wiring pattern 35.

When the FCP 45 is connected to the wiring pattern 35, the head driving circuit 47 is electrically connected to the electrodes 28 via the wirings of the FCP 45. The head driving circuit 47 applies a voltage to the electrodes 28 via the wirings of the film 46.

When the head driving circuit 47 applies a voltage to the electrodes 28, the driving elements 18 is subjected to shear mode deformation, and thus the volume of the pressure chamber 51 in which the electrodes 28 are formed is increased or decreased. Thus, a pressure of the ink inside the pressure chamber 51 is changed, and thus the ink is ejected from the nozzles 25. In this way, the driving element 18 isolating the pressure chamber 51 serves as an actuator that provide pressure vibration to the inside of the pressure chamber 51.

The circulation devices 20 illustrated in FIG. 1 are integrally connected to the upper portions of the inkjet heads 10 by connection component made of metal. The circulation device 20 includes a predetermined circulation path formed so that a liquid is circulated via the ink tank and the inkjet head 10. The circulation device 20 includes a pump that circulates a liquid. The liquid is supplied from the circulation device 20 to the inkjet head 10 via the ink supply portion by a function of the pump, passes along a predetermined flow path, and is subsequently sent from the inkjet head 10 to the circulation device 20 via the ink discharge portion.

The circulation device 20 supplies the liquid from a cartridge serving as a supply tank installed outside the circulation path to the circulation path.

Figure 5:
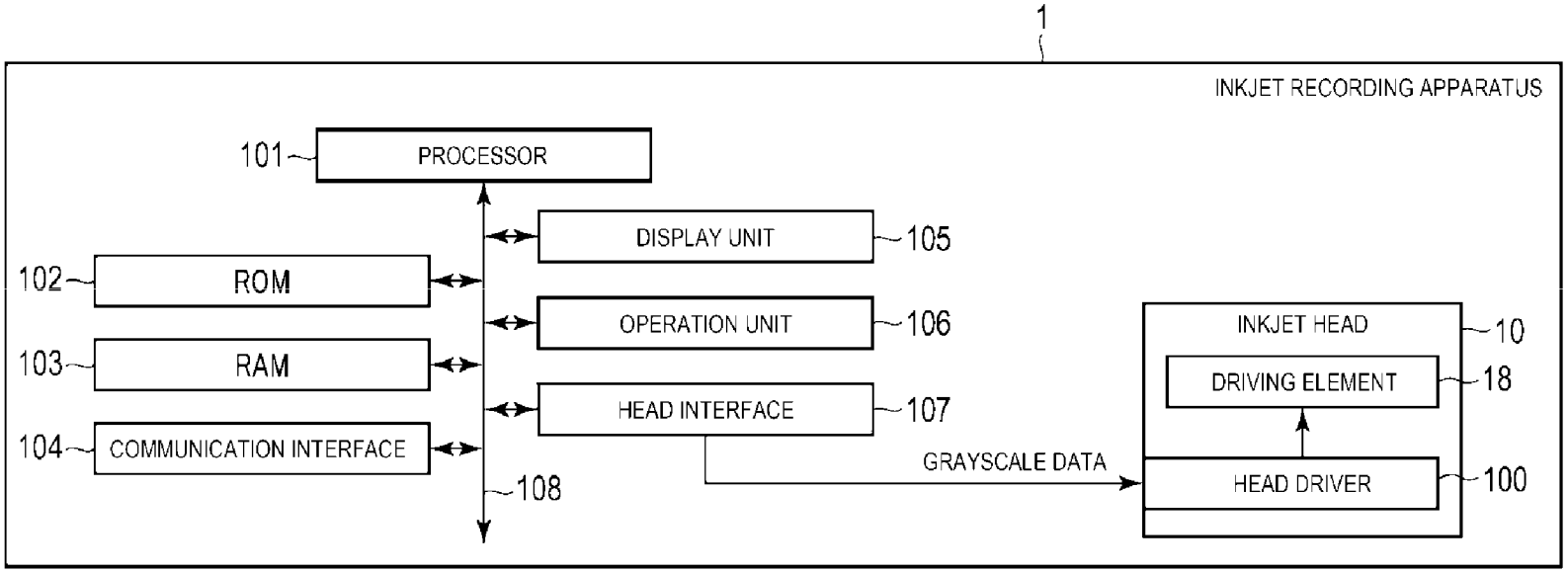
FIG. 5 is a block diagram illustrating an example of a main circuit configuration of the inkjet recording apparatus illustrated in FIG. 1.

A main circuit configuration of the inkjet recording apparatus 1 will be described. FIG. 5 is a block diagram illustrating an example of the main circuit configuration of the inkjet recording apparatus 1 according to the first embodiment.

The inkjet recording apparatus 1 includes a processor 101, a read-only memory (ROM) 102, a random access memory (RAM) 103, a communication interface 104, a display unit 105, an operation unit 106, a head interface 107, a bus 108, and an inkjet head 10.

The processor 101 is equivalent to a central portion of a computer that performs processing and controlling necessary for an operation of the inkjet recording apparatus 1. The processor 101 controls each unit such that various functions of the inkjet recording apparatus 1 can be realized based on programs such as system software, application software, or firmware stored in the ROM 102. The processor 101 is, for example, a central processing unit (CPU), a micro processing unit (MPU), a system on a chip (SoC), a digital signal processor (DSP), or a graphics processing unit (GPU). Alternatively, the processor 101 is a combination thereof.

The ROM 102 is a nonvolatile memory that is equivalent to a main storage portion of a computer using the processor 101 as a center and is used only to read data. The ROM 102 stores the foregoing programs. The ROM 102 stores data, various setting values, or the like for the processor 101 to perform various processes.

The RAM 103 is a memory that is equivalent to a main storage portion of the computer using the processor 101 and is used to read and write data. The RAM 103 is used as a work area or the like that stores data temporarily used for the processor 101 to perform various processes.

The communication interface 104 is an interface through which the inkjet recording apparatus 1 communicates a host computer or the like via a network, a communication cable, or the like.

The display unit 105 displays a screen for notifying an operator of the inkjet recording apparatus 1 of various kinds of information. The display unit 105 is, for example, a display such as a liquid crystal display or an organic electro-luminescence (EL) display.

The operation unit 106 receives an operation by the operator of the inkjet recording apparatus 1. The operation unit 106 is, for example, a keyboard, a keypad, a touch pad, or a mouse. As the operation unit 106, a touch pad disposed to be superimposed on a display panel of the display unit 105 can also be used. That is, a display panel included in a touch panel can be used as the display unit 105 and a touch pad included in a touch panel can be used as the operation unit 106.

The head interface 107 is installed so that the processor 101 communicates with the inkjet head 10. The head interface 107 transmits grayscale data or the like to the inkjet head 10 under the control of the processor 101.

The bus 108 includes a control bus, an address bus, and a data bus and transmits a signal transmitted to and received from each unit of the inkjet recording apparatus 1.

The inkjet head 10 includes a head driver 100.

The head driver 100 is a driving circuit that operates the inkjet head 10. The head driver 100 is, for example, a line driver. The head driver 100 generates a driving signal to be applied to each of the driving elements 18 based on the input grayscale data. Then, the head driver 100 applies the generated driving signal to each of the driving elements 18. The head driver 100 is an example of the driving device. The head driver 100 operates as an application unit by applying the driving signal to the driving element 18.

By applying the driving signal, the driving element 18 which is a piezoelectric element is subjected to shear mode deformation. Through the deformation, the pressure chamber 51 is contracted and the volume of the pressure chamber 51 is decreased when the potential of the driving signal is positive. The pressure chamber 51 is expanded and the volume of the pressure chamber 51 is increased when the potential of the driving signal is negative. Then, the pressure of the ink inside the pressure chamber 51 is changed with a witch in the volume of the pressure chamber 51 described above. For example, the inkjet head 10 ejects the ink by expanding and then contracting the pressure chamber 51. The waveform of the driving signal is referred to as a "driving waveform".

Figure 6:
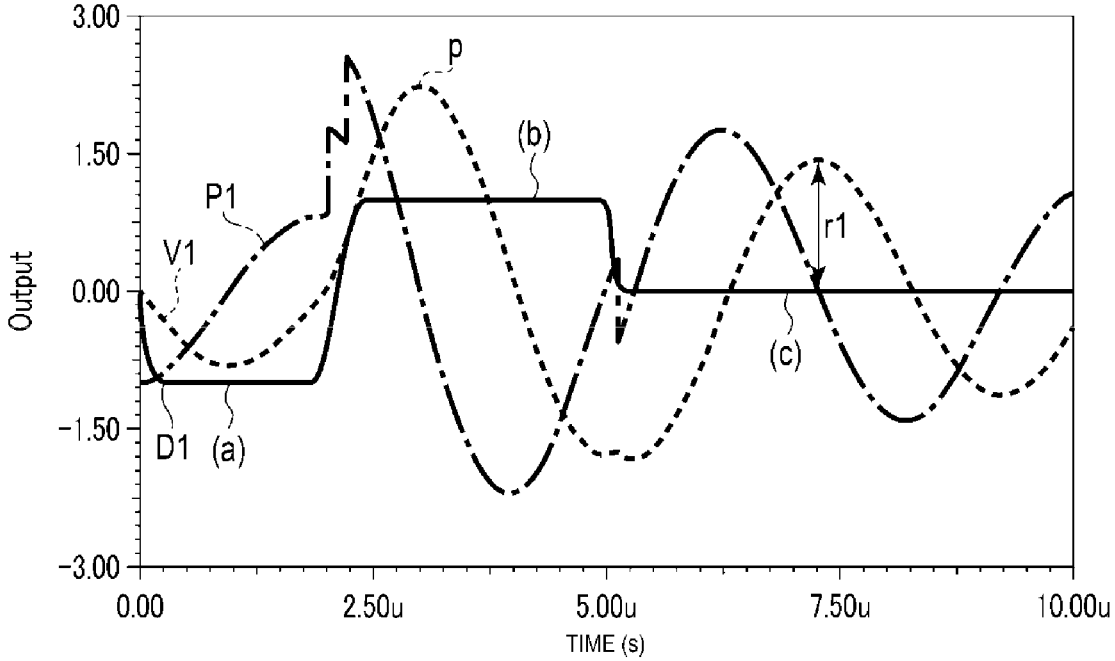
FIG. 6 is a diagram illustrating a driving waveform related to a first analysis model and temporal changes in a nozzle flow rate and a nozzle pressure when the driving waveform is applied.

An example of a driving waveform according to the first embodiment will be described with reference to FIG. 6. The waveform D1 in FIG. 6 indicates an example of a driving wave which the head driver 100 applies to the actuator when ink equivalent to one droplet is ejected from the nozzle 25. FIG. 6 is a diagram related to a first analysis model to be described below and is obtained through numeric analysis.

The driving waveform according to the first embodiment is, for example, a waveform in which the potential varies in order of a negative potential (a), a positive potential (b), and a zero potential (c), as indicated by D1 in FIG. 6. The negative potential (a) and the positive potential (b) each have a single rectangular waveform. By applying the negative potential (a) before applying the positive potential (b), the pressure chamber enters a contraction state from an expansion state when the subsequently continuing positive potential (b) is applied. Thus, a pressure change amount at the time of applying the positive potential (b) is larger than when the pressure chamber enters the contraction state from a normal state in which the pressure chamber is not contracted and expanded. Thus, ejection efficiency of the ink is improved. Then, by applying the positive potential (b), the ink starts to be ejected when a speed (hereinafter referred to as a "nozzle flow rate") V1 of a liquid (ink) on a meniscus surface at an opening surface of the nozzle is near a first positive peak P1. The nozzle flow rate is a speed when a direction in which the ink is ejected vertically to an opening surface of the nozzle (hereinafter referred to as a "nozzle surface") is positive or the direction of an ink chamber side vertical to the nozzle surface is negative. A pressure of the liquid (ink) on the meniscus surface at the opening surface of the nozzle is referred to as a "nozzle pressure" below. For the nozzle pressure, as in the nozzle flow rate, the direction in which the ink is ejected outward from the nozzle surface is positive and the direction back towards the ink chamber side to the nozzle surface is negative.

By applying the negative potential (a), the pressure chamber 51 is expanded. Thus, the pressure is decreased for the ink inside the pressure chamber 51. Accordingly, the negative potential (a) is an example of a first expansion pulse for driving the actuator so that the pressure of the pressure chamber is decreased. By applying the positive potential (b), the pressure chamber 51 is contracted. Thus, the pressure is increased for the ink inside the pressure chamber 51. Accordingly, the positive potential (b) is an example of a contraction pulse for driving the actuator so that the pressure of the pressure chamber is increased.

When AL is a half time of an ink-inherent oscillation period (ink propagation time) of the ink chamber 19, an application time of the negative potential (a) is preferably is 1 AL.

That is, an application time of the negative potential (a) is preferably a half time of the ink-inherent oscillation period of the ink chamber 19.

In accordance with the forgoing conditions, the ink is efficiently ejected.

An application time of the positive potential (b) is preferably equal to or greater than 1 AL and less than 2 AL when the application time of the negative potential (a) is 1 AL. The application time of the positive potential (b) is more preferably equal to or greater than 1 AL and equal to or less than 1.8 AL. The application time of the positive potential (b) is further more preferably equal to or greater than 1.2 AL and equal to or less than 1.6 AL. Particularly preferably, the application time of the positive potential (b) is 1.5 AL.

That is, the application of the positive potential (b) preferably ends when 2 AL or more passes from start of the application of the negative potential (a) and before 3 AL passes. The application of the positive potential (b) more preferably ends when 2 AL or more passes from the start of the application of the negative potential (a) and before 2.8 AL passes. The application of the positive potential (b) further more preferably ends before 2.6 AL passes from the start of the application of the negative potential (a). The application of the positive potential (b) particularly preferably ends when 2.5 AL passes from the start of the application of the negative potential (a).

As known from V1 in FIG. 6, the nozzle flow rate indicates a negative value until 1 AL passes from the start of the application of the negative potential (a). The nozzle flow rate indicates a positive value until 2 AL passes from the start of the application of the negative potential (a) after 1 AL passes from the start of the application of the negative potential (a). Further, the nozzle flow rate indicates a negative value until 3 AL passes from the start of the application of the negative potential (a) after 2 AL passes from the start of the application of the negative potential (a). The nozzle flow rate indicates a negative peak when 2.5 AL passes from the start of the application of the negative potential (a). Accordingly, the application of the positive potential (b) preferably ends when the nozzle flow rate is a negative value. The application of the positive potential (b) more preferably ends when the nozzle flow rate is a negative peak.

The inkjet recording apparatus 1 can suppress occurrence of a satellite droplet by applying the driving waveform according to the first embodiment.

Hereinafter, the driving waveform according to the first embodiment will be described with reference to a comparative analysis model and first to seventh analysis models. The comparative analysis model and the first to seventh analysis models are analysis models based on numeric analysis. In the following description, the nozzle pressure is a pressure when the direction in which the ink is ejected vertically to the nozzle surface is positive and the direction of the ink chamber side vertical to the nozzle surface is negative. The driving waveform illustrated in the drawings in each analysis model refers to a driving waveform which the head driver 100 applies to the actuator to eject the ink equivalent to one droplet from the nozzle 25.

Comparative Analysis Model

Figure 7:
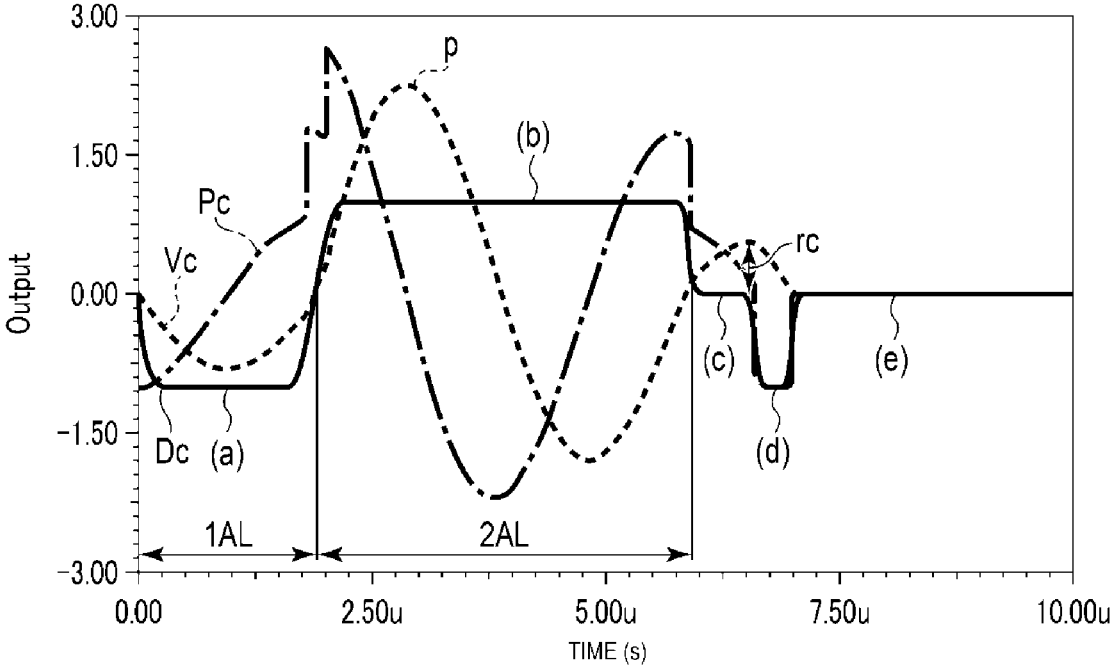
FIG. 7 is a diagram illustrating a driving waveform related to a comparative analysis model and temporal changes in a nozzle flow rate and a nozzle pressure when the driving waveform is applied.

A driving waveform in a comparative analysis model is an example of a driving waveform used in an inkjet recording apparatus of the related art. The driving waveform of the comparative analysis model is illustrated in FIG. 7. FIG. 7 illustrates a driving waveform Dc related to the comparative analysis model. FIG. 7 illustrates temporal changes in a nozzle flow rate Vc and a nozzle pressure Pc when the driving waveform Dc is applied.

For the driving waveform Dc of the comparative analysis model, after the negative potential (a) is applied for 1 AL, the positive potential (b) is subsequently applied for 2 AL. Then, after the zero potential (c), the negative potential (d) is applied.

First Analysis Model

The driving waveform of the first analysis model is illustrated in FIG. 6. FIG. 6 illustrates a driving waveform D1 related to the first analysis model. FIG. 6 illustrates temporal changes in a nozzle flow rate V1 and a nozzle pressure P1 when the driving waveform D1 is applied.

For the driving waveform D1 of the first analysis model, after the negative potential (a) is applied for 1 AL, the positive potential (b) is applied for 1.5 AL which is a shorter time than 2 AL.

Second Analysis Model

Figure 8:
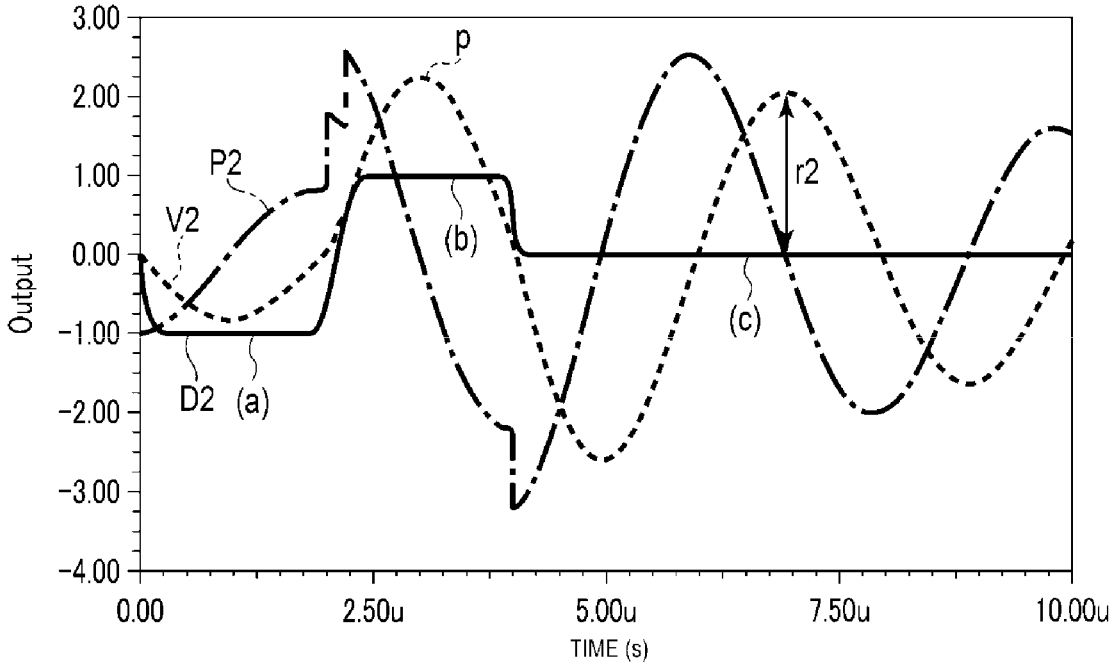
FIG. 8 is a diagram illustrating a driving waveform related to a second analysis model and temporal changes in a nozzle flow rate and a nozzle pressure when the driving waveform is applied.

The driving waveform of the second analysis model is illustrated in FIG. 8. FIG. 8 illustrates a driving waveform D2 related to the second analysis model. FIG. 8 illustrates temporal changes in a nozzle flow rate V2 and a nozzle pressure P2 when the driving waveform D2 is applied.

For the driving waveform D2 of the second analysis model, after the negative potential (a) is applied for 1 AL, the positive potential (b) is applied for 1 AL.

Third Analysis Model

Figure 9:
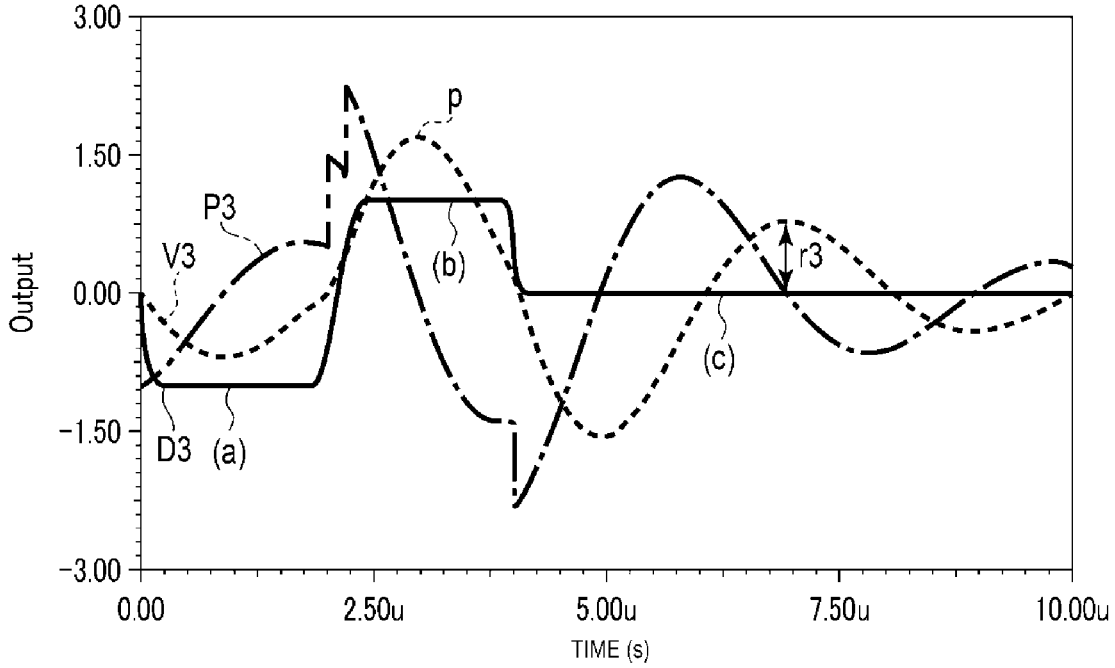
FIG. 9 is a diagram illustrating a driving waveform related to a third analysis model and temporal changes in a nozzle flow rate and a nozzle pressure when the driving waveform is applied.

The driving waveform of the third analysis model is illustrated in FIG. 9. FIG. 9 illustrates a driving waveform D3 related to the third analysis model. FIG. 9 illustrates temporal changes in a nozzle flow rate V3 and a nozzle pressure P3 when the driving waveform D3 is applied.

The driving waveform D3 of the third analysis model is the same as the driving waveform of the second analysis model. Here, in the third analysis model, numeric analysis is performed using ink with an attenuation factor greater than the ink in which the second analysis model is used. For example, the attenuation factor tends to increase as the ink has a higher coefficient of viscosity.

Fourth to Seventh Analysis Models

For driving waveforms of the fourth to seventh analysis models, the application time of the positive potential (b) of the driving waveform of the comparative analysis model is changed variously. On the assumption that the application time of the positive potential (b) of the comparative analysis model is 100% (=2 AL) of the ink-inherent oscillation period, an application time of the positive potential (b) of each analysis model is set within the following ranges:

100%=the application time of the positive potential (b) of the comparative analysis mode;

98%>the application time of the positive potential (b) of the fourth analysis model>97%;

95%>the application time of the positive potential (b) of the fifth analysis model>94%;

93%>the application time of the positive potential (b) of the sixth analysis model>92%; and 90%>the application time of the positive potential (b) of the seventh analysis model>89%.

Figure 10:
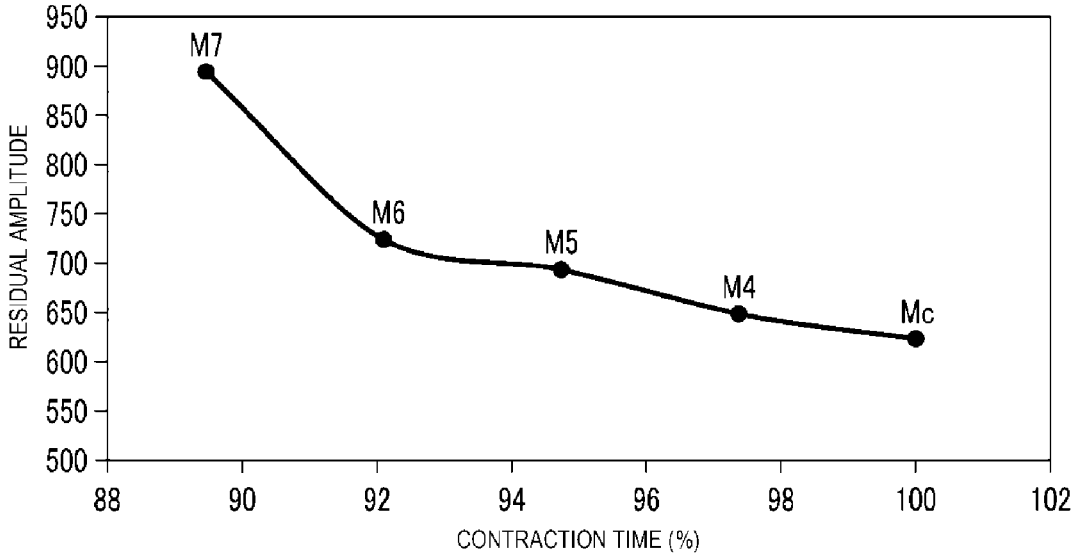
FIG. 10 is a graph illustrating a relation between a contraction time and a residual amplitude in the fourth to seventh analysis models and the comparative analysis model.

For each of the foregoing comparative analysis model and fourth to seventh analysis models, the magnitude of the residual amplitude has been derived. This result is illustrated in the graph of FIG. 10. FIG. 10 is a graph illustrating a relation between a contraction time (the application time of the positive potential (b)) and a residual amplitude in the fourth to seventh analysis models and the comparative analysis model. In FIG. 10, a point Mc indicates the comparative analysis model and points M4 to M7 indicate the fourth to seventh analysis models, respectively.

In the comparative analysis model, as illustrated in FIG. 7, it can be understood that the nozzle flow rate Vc is changed so as to be abruptly suppressed at the time of ending the application of the positive potential (b). On the other hand, in the first analysis model, as illustrated in FIG. 6, it can be understood that a change the nozzle flow rate V1 is abruptly suppressed at the time of ending the application of the positive potential (b) does not occur. It can be understood that a residual amplitude rc related to the comparative analysis model is less than a residual amplitude r1 related to the first analysis model.

Figure 11A:
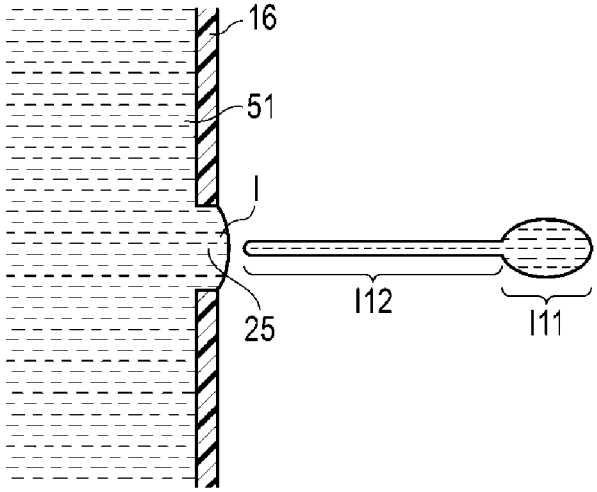
FIGS. 11A and 11B are schematic views illustrating an example of a flying shape of a liquid droplet in the related example.
Figure 11B:
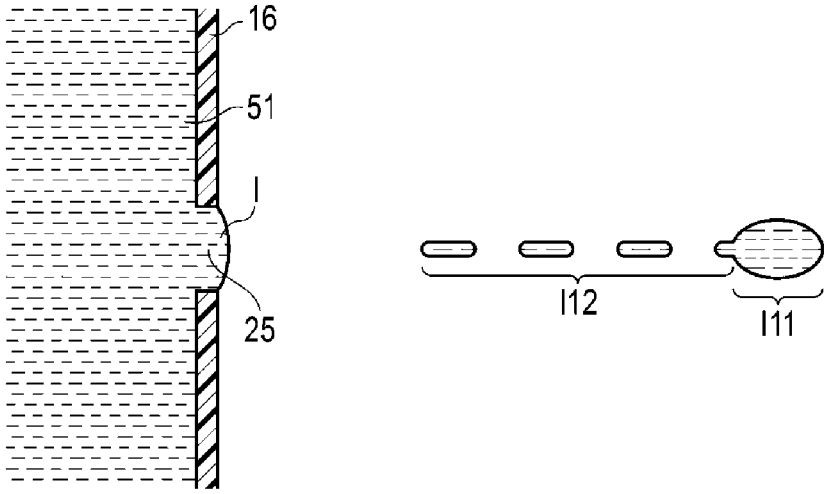

In the comparative analysis model, due to the foregoing change in the flow rate, the ink is ejected in a shape illustrated in FIGS. 11A and 11B. FIGS. 11A and 11B are schematic views illustrating an example of a flying shape of a liquid droplet in the related example. Ink I ejected from the nozzle 25 is formed by a main droplet I11 and a tailing portion I12, as illustrated in FIG. 11A. Since the nozzle flow rate Vc is changed so as to be abruptly suppressed and the residual amplitude rc is small, a flow rate of the tailing portion I12 of the ejected ink at the nozzle side end enters an abrupt suppression state. Accordingly, the tailing portion I12 is stretched in length. This is because the traveling speed of the tailing portion I12 is slow and the tailing portion I12 may not be aggregated with the main droplet I11. The tailing portion I12 is more easily segmented as the length of the tailing portion I12 is longer. Therefore, the tailing portion I12 is segmented into smaller pieces during the traveling, as illustrated in FIG. 11B. Then, the segmented tailing portion I12 is considered to be a cause of a satellite droplet.

Figure 12A:
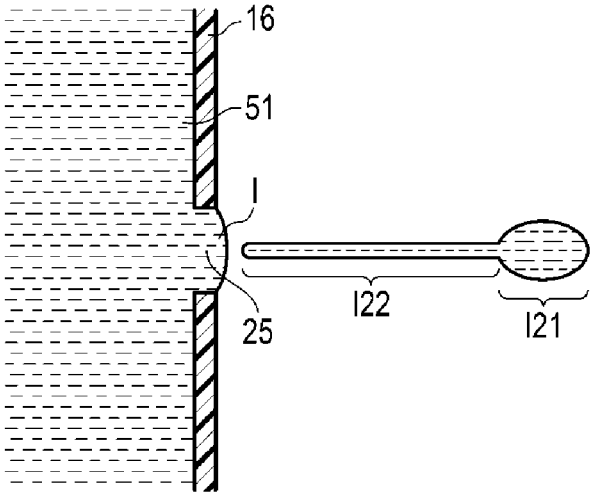
FIGS. 12A and 12B are schematic views illustrating an example of a flying shape of a liquid droplet according to the embodiment.
Figure 12B:
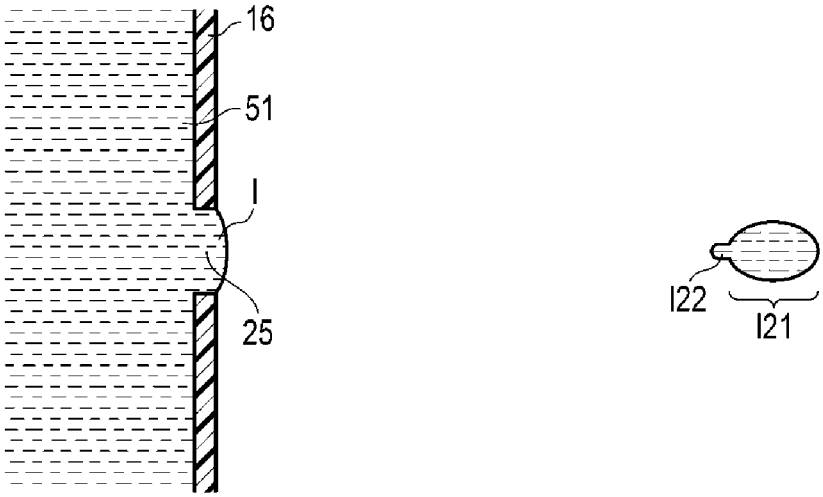

In the first analysis model, the ink I is ejected in a shape illustrated in FIGS. 12A and 12B. FIGS. 12A and 12B are schematic views illustrating an example shape of a liquid droplet according to the embodiment. The ink I ejected from the nozzle 25 is formed by a main droplet I21 and a tailing portion I22, as illustrated in FIG. 12A. In the first analysis model, since the ejection of the ink ends in a state in which the residual amplitude r1 is greater than in the comparative analysis model, as described above, the flow rate of the tailing portion I22 at the nozzle side end does not enter the abrupt suppression state. Accordingly, the main droplet I21 and the tailing portion I22 of the ejected ink I are aggregated and the length of the tailing portion I22 is shortened, as illustrated in FIG. 12B. When a difference in a speed between the tailing portion I22 and the main droplet I21, the surface tension of the ink, and the like satisfy given conditions, the easiness of the aggregation of the tailing portion I22 and the main droplet I21 is considered to be changed. That is, the tailing portion I22 can follow the main droplet I21 more easily as ((the speed of the tailing portion I22)−(the speed of the main droplet I21)) is larger. Therefore, it is considered that it is easy for the tailing portion I22 and the main droplet I21 to aggregate each other. Since a cohesive force of the ink I is larger as the surface tension of the ink I is larger. Therefore, it is considered that it is easy for the tailing portion I22 and the main droplet I21 to be cohesive. As described above, when the length of the tailing portion I22 is shortened, the tailing portion I22 is not easily segmented. Therefore, occurrence of a satellite droplet is suppressed.

From the viewpoint of the above description, when the application time of the positive potential (b) is 1.5 AL shorter than 2 AL, it can be understood that the effect of suppressing occurrence of a satellite droplet can be obtained.

In the second analysis model, a change such as the abrupt suppression of the nozzle flow rate V2 at the time of ending the application of the positive potential (b) does not occur. The residual amplitude r2 is greater than the residual amplitude rc of the comparative analysis model. Therefore, the trailing portion I22 is shortened as in the first analysis model. Accordingly, when the application time of the positive potential (b) is 1 AL, it can be understood that the effect of suppressing occurrence of a satellite droplet can be obtained. However, since the residual amplitude r2 has a magnitude close to the amplitude at the peak p, a possibility of ejecting the ink at the time of the peak of the residual amplitude r2 is higher in the second analysis model than in the first analysis mode. Accordingly, when the application time of the positive potential (b) is too short, a possibility of erroneous ejection is considered to increase. From the viewpoint of the above description, it can be understood that the application time of the positive potential (b) is preferably 1.5 AL rather than 1 AL.

In the third analysis model, as in the second analysis mode, a change such as the abrupt suppression of the nozzle flow rate V3 at the time of ending the application of the positive potential (b) does not occur. The residual amplitude r3 is greater than the residual amplitude rc of the comparative analysis model. Accordingly, as in the second analysis model, when the application time of the positive potential (b) is 1 AL, it can be understood that the effect of suppressing occurrence of a satellite droplet can be obtained. Here, in the third analysis model, the residual amplitude r3 is less than in the second analysis model. This is because the attenuation factor of the ink is large. Accordingly, when the attenuation factor of the ink is large, it can be understood that erroneous ejection does not easily occur despite a short application time of the positive potential (b). That is, it can be understood that if the attenuation factor of the ink is large, it is preferable that the application time of the positive potential (b) is shorter than that of the ink with a small attenuation factor in order to keep a sufficient residual amplitude. For the application time of the positive potential (b), a peak (a second positive peak) of the residual amplitude is preferably equal to or greater than 30% and equal to or less than 65% of the first positive peak according to the attenuation factor of the ink. It is considered that it is not preferable that the application time of the positive potential (b) is shorter than 1 AL since ejection efficiency (ejection amount) of the ink degrades and oscillation amplitude of a flow rate accordingly decreases.

As illustrated in FIG. 10, it can be understood that in any of the fourth to seventh analysis models, the residual amplitude is greater than in the comparative analysis model. Accordingly, it can be understood that the effect of suppressing occurrence of a satellite droplet can be obtained when the contraction time (the application time of the positive potential (b)) is less than 100% (2 AL). As illustrated in FIG. 10, it can be understood that as the contraction time is shorter, the residual amplitude is larger in the range of the contraction time from 89% to 100% and the effect of suppressing occurrence of a satellite droplet is high. In particular, a difference in the magnitude of the residual amplitude between the seventh and sixth analysis models is considerably greater than a difference in the magnitude of the residual amplitude between the sixth and fifth analysis models, a difference in the magnitude of the residual amplitude between the fifth and fourth analysis models, and a difference in the magnitude of the residual amplitude between the fourth and comparative analysis models. From the above description, it can be understood that the effect of suppressing occurrence of a satellite droplet can be preferably obtained when the contraction time (the application time of the positive potential (b)) is equal to or less than 90% (1.8 AL).

Second Embodiment

An inkjet recording apparatus 1 according to a second embodiment will be described. The inkjet recording apparatus 1 according to the second embodiment has the same configuration as that according to the first embodiment, and thus the description thereof will be omitted.

Figure 13:
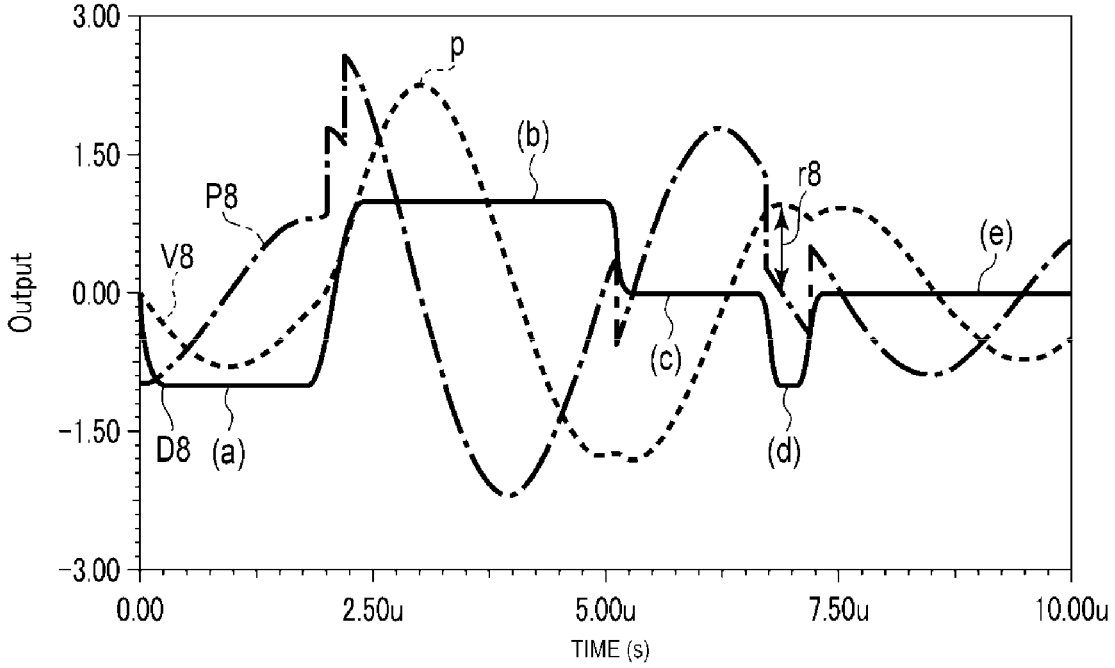
FIG. 13 is a diagram illustrating a driving waveform related to an eighth analysis model and temporal changes in a nozzle flow rate and a nozzle pressure when the driving waveform is applied.

A driving waveform according to the second embodiment will be described with reference to FIG. 13. D8 in FIG. 13 indicates an example of a driving waveform which the head driver 100 applies to the actuator when ink equivalent to one droplet is ejected from the nozzle 25. FIG. 13 is a diagram related to an eighth analysis model to be described below and obtained through numeric analysis.

The driving waveform according to the second embodiment is, for example, a waveform in which the potential varies in order of a negative potential (a), a positive potential (b), a zero potential (c), a negative potential (d), and a zero potential (e), as indicated by D8 in FIG. 13. The negative potential (a) and the positive potential (b) in the driving waveform according to the second embodiment are the same those in the driving waveform according to the first embodiment, and thus the description thereof will be omitted.

The negative potential (d) has a single rectangular waveform as in the negative potential (a) and the positive potential (b).

By applying the negative potential (d), the pressure chamber 51 is expanded. Thus, the pressure of the ink inside the pressure chamber 51 is decreased. Accordingly, the negative potential (d) is an example of a second expansion pulse for driving the actuator so that the pressure of the pressure chamber is decreased.

The application of the negative potential (d) preferably starts when 3 AL or more passes from the start of the application of the negative potential (a) and before 4 AL passes. Then, the application of the negative potential (d) preferably ends when 3 AL or more passes from the start of the application of the negative potential (a) and before 4 AL passes.

When the negative potential (d) is not applied, the nozzle flow rate indicates a negative value until 3 AL passes from the start of the application of the negative potential (a) after 2 AL passes from the start of the application of the negative potential (a). Then, when the negative potential (d) is not applied, the nozzle flow rate indicates a positive value until 4 AL passes from the start of the application of the negative potential (a) after 3 AL passes from the start of the application of the negative potential (a). From the viewpoint of the above description, a period in which the nozzle flow rate is equal to or greater than 0 when the negative potential (d) is not applied is referred to as a "specific period" below. From the viewpoint of the above description, the application of the negative potential (d) preferably starts within the specific period. Then, the application of the negative potential (d) preferably ends within a specific period. The application of the negative potential (d) more preferably ends when the nozzle flow rate is 0.

The driving waveform according to the second embodiment also satisfies the condition of the driving waveform according to the first embodiment. Accordingly, the inkjet recording apparatus 1 can suppress occurrence of a satellite droplet as in the first embodiment by applying the driving waveform according to the second embodiment.

The inkjet recording apparatus 1 can suppress erroneous ejection of the ink by applying the driving waveform according to the second embodiment.

Hereinafter, the driving waveform according to the second embodiment will be further described based on the comparative and eighth analysis models. The eighth analysis model is an analysis model based on numeric analysis as in the comparative analysis model and the first to seventh analysis models.

Eighth Analysis Model

The driving waveform of the eighth analysis model is illustrated in FIG. 13. FIG. 13 illustrates a driving waveform D8 related to the eighth analysis model. FIG. 13 illustrates temporal changes in a nozzle flow rate V8 and a nozzle pressure P8 when the driving waveform D8 is applied.

For the driving waveform D8, the positive potential (b) is applied for a time shorter than 2 AL after the negative potential (a) is applied for 1 AL. The application of the negative potential (d) starts when 3 AL passes from the start of the application of the negative potential (a) after the zero potential (c) and before 3.5 AL passes. Then, for the driving waveform D8, the application of the negative potential (d) ends before 3.5 AL passes from the start of the application of the negative potential (a).

Even in the eighth analysis model, a change such as the abrupt suppression of the nozzle flow rate V8 at the time of ending the application of the positive potential (b) does not occur and a residual amplitude r8 is greater than in the comparative analysis model. Accordingly, even in the eighth analysis model, it can be understood that the effect of suppressing occurrence of a satellite droplet can be obtained.

In the eighth analysis model, when the negative potential (d) is applied, a peak of the residual amplitude r8 is suppressed further than when the negative potential (d) is not applied as in the first embodiment. Accordingly, by applying the negative potential (d) appearing in the eighth analysis model, it is possible to obtain the effect of further suppressing erroneous ejection of the ink than when the negative potential (d) is not applied.

Third Embodiment

An inkjet recording apparatus 1 according to the third embodiment will be described. The inkjet recording apparatus 1 according to the third embodiment has the same configuration as that according to the first embodiment, and thus the description thereof will be omitted.

Figure 14:
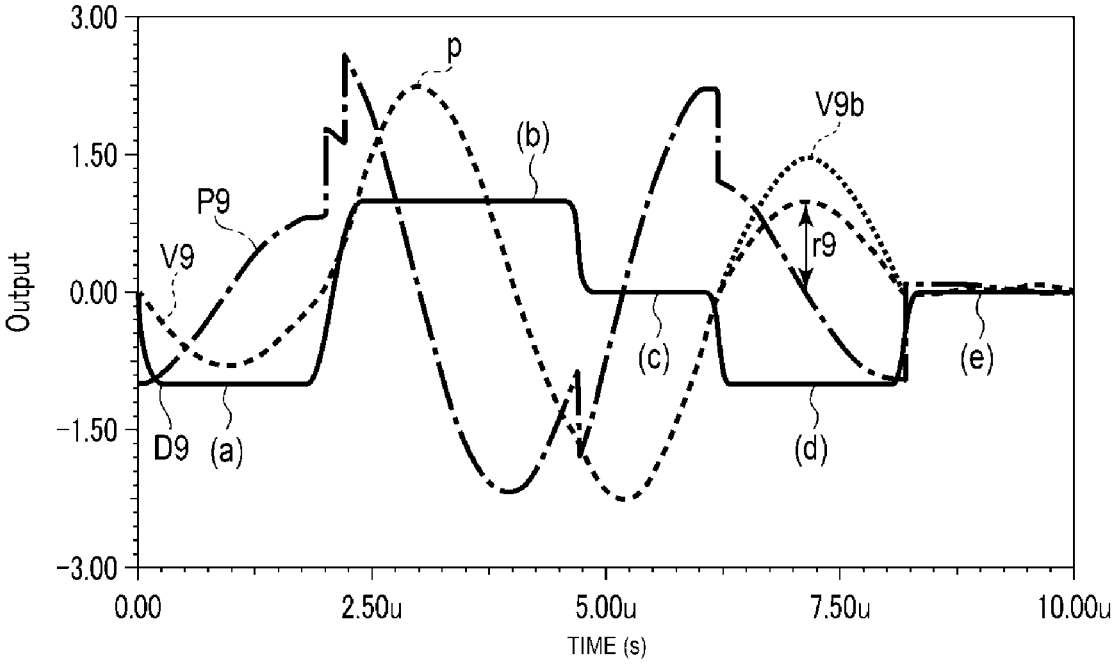
FIG. 14 is a diagram illustrating a driving waveform related to a ninth analysis model and temporal changes in a nozzle flow rate and a nozzle pressure when the driving waveform is applied.

A driving waveform according to the third embodiment will be described with reference to FIG. 14. D9 in FIG. 14 indicates an example of a driving waveform which the head driver 100 applies to the actuator when ink equivalent to one droplet is ejected from the nozzle 25. FIG. 14 is a diagram related to a ninth analysis model to be described below is obtained through numeric analysis.

The driving waveform according to the third embodiment is, for example, a waveform in which the potential varies in order of a negative potential (a), a positive potential (b), a zero potential (c), a negative potential (d), and a zero potential (e), as indicated by D9 in FIG. 14. The negative potential (a) and the positive potential (b) in the driving waveform according to the third embodiment are the same those in the driving waveform according to the first and second embodiments, and thus the description thereof will be omitted.

The negative potential (d) according to the third embodiment has a single rectangular waveform as in the second embodiment.

The application of the negative potential (d) according to the third embodiment preferably starts when 3 AL or more passes from the start of the application of the negative potential (a) and before 3.5 AL passes. Then, the application of the negative potential (d) preferably ends when 3.5 AL or more passes from the start of the application of the negative potential (a) and before 4 AL passes.

The nozzle flow rate indicates a waveform indicated by V9*b* in FIG. 14 when the negative potential (d) is not applied. That is, the nozzle flow rate indicates the second positive peak when 3.5 AL passes from start of the application of the negative potential (a) when the negative potential (d) is not applied. A time at which the nozzle flow rate indicates the second positive peak when the negative potential (d) is not applied is referred to as a "specific timing" below. Accordingly, the application of the negative potential (d) preferably starts earlier than the specific timing. The application of the negative potential (d) preferably ends later than the specific timing. That is, an application period from start to end of the application of the negative potential (d) preferably exceeds the specific timing.

The application of the negative potential (d) preferably ends when the nozzle flow rate is 0.

The driving waveform according to the third embodiment also satisfies the condition of the driving waveform according to the first embodiment. Accordingly, the inkjet recording apparatus 1 can suppress occurrence of a satellite droplet as in the first and second embodiments by applying the driving waveform according to the third embodiment.

The driving waveform according to the third embodiment also satisfies the condition of the driving waveform according to the second embodiment. Accordingly, the inkjet recording apparatus 1 can suppress erroneous ejection of the ink by applying the driving waveform according to the third embodiment as in the second embodiment.

Further, by applying the driving waveform according to the third embodiment, the inkjet recording apparatus 1 can suppress the residual oscillation. Thus, since the inkjet head 10 can perform a subsequent ink ejection operation immediately, it is possible to improve the number of times the ink is ejected per time. That is, it is possible to improve a driving frequency.

Ninth Analysis Model

The driving waveform of the ninth analysis model is illustrated in FIG. 14. FIG. 14 illustrates a driving waveform D9 related to the ninth analysis model. FIG. 14 illustrates temporal changes in a nozzle flow rate V9 and a nozzle pressure P9 when the driving waveform D9 is applied. Further, in FIG. 14, a waveform V9*b* indicates a half waveform of a residual amplitude at the time of non-application of the negative potential (d).

For the driving waveform D9, the positive potential (b) is applied for a time shorter than 2 AL after the negative potential (a) is applied for 1 AL. The application of the negative potential (d) starts when 3 AL passes from the start of the application of the negative potential (a) after the zero potential (c). Then, for the driving waveform D9, the application of the negative potential (d) ends before 4 AL passes from the start of the application of the negative potential (a).

Tenth Analysis Model

Figure 15:
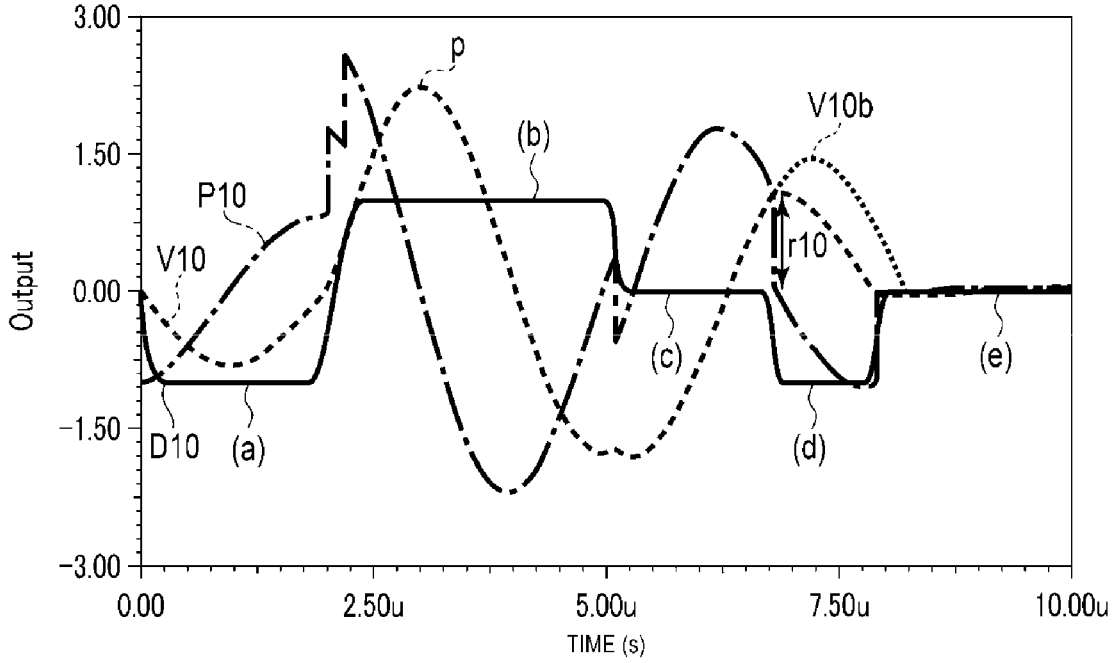
FIG. 15 is a diagram illustrating a driving waveform related to a tenth analysis model and temporal changes in a nozzle flow rate and a nozzle pressure when the driving waveform is applied.

The driving waveform of the tenth analysis model is illustrated in FIG. 15. FIG. 15 illustrates a driving waveform D10 related to the tenth analysis model. FIG. 15 illustrates temporal changes in a nozzle flow rate V10 and a nozzle pressure P10 when the driving waveform D10 is applied. Further, in FIG. 15, a waveform V10*b* indicates a half waveform of a residual amplitude at the time of non-application of the negative potential (d).

For the driving waveform D10, the positive potential (b) is applied for a time shorter than 2 AL after the negative potential (a) is applied for 1 AL. The application of the negative potential (d) starts when 3 AL passes from the start of the application of the negative potential (a) after the zero potential (c) and before 3.5 AL passes. Then, for the driving waveform D10, the application of the negative potential (d) ends when 3.5 AL passes from the start of the application of the negative potential (a) and before 4 AL passes.

Even in the ninth and tenth analysis models, a change such as the abrupt suppression of the nozzle flow rates V9 and V10 at the time of ending the application of the positive potential (b) does not occur and residual amplitudes r9 and r10 are greater than the residual amplitude rc of the comparative analysis model. Accordingly, even in the ninth and tenth analysis models, it can be understood that the effect of suppressing occurrence of a satellite droplet can be obtained.

Even in the ninth and tenth analysis models, when the negative potential (d) is applied, peaks of the residual amplitudes r9 and r10 are suppressed further in comparison to the nozzle flow rate V9 or V10 and the waveform V9*b* or V10*b*. Accordingly, even when the negative potential (d) appearing in the ninth and tenth analysis models is applied, it is possible to obtain the effect of further suppressing erroneous ejection of the ink than when the negative potential (d) is not applied.

Further, in the ninth and tenth analysis models, as illustrated in FIGS. 14 and 15, it can be understood that the residual oscillation after the end of the application of the negative potential (d) (when the driving waveform is at the zero potential (e)) is further suppressed in comparison to the eighth analysis model. In both the ninth and tenth analysis models, the application of the negative potential (d) starts before the peak of the waveform V9*b* or V10*b*. In both the ninth and tenth analysis models, the application of the negative potential (d) ends after the peak of the waveform V9*b* or V10*b*. Accordingly, by comparing the eighth analysis model with the ninth and tenth analysis models, it can be understood that the effect of suppressing the residual oscillation after the end of the application of the negative potential (d) can be obtained by applying the negative potential (d) over a period including the specific timing. This effect can be obtained when the specific timing is located at a zero pressure at which a nozzle pressure changes from a positive value to a negative value. That is, when the negative potential (d) is applied at the time of a positive nozzle pressure, the nozzle pressure decreases that much, and thus it is possible to suppress the peak of the nozzle flow rate. When the application of the negative potential (d) ends at the time when the nozzle flow rate is 0, it can be understood that the effect of suppressing the residual oscillation after the end of the application of the negative potential (d) can be obtained.

Fourth Embodiment

An inkjet recording apparatus 1 according to a fourth embodiment will be described. The inkjet recording apparatus 1 according to the fourth embodiment has the same configuration as that according to the first embodiment, and thus the description thereof will be omitted.

Figure 16:
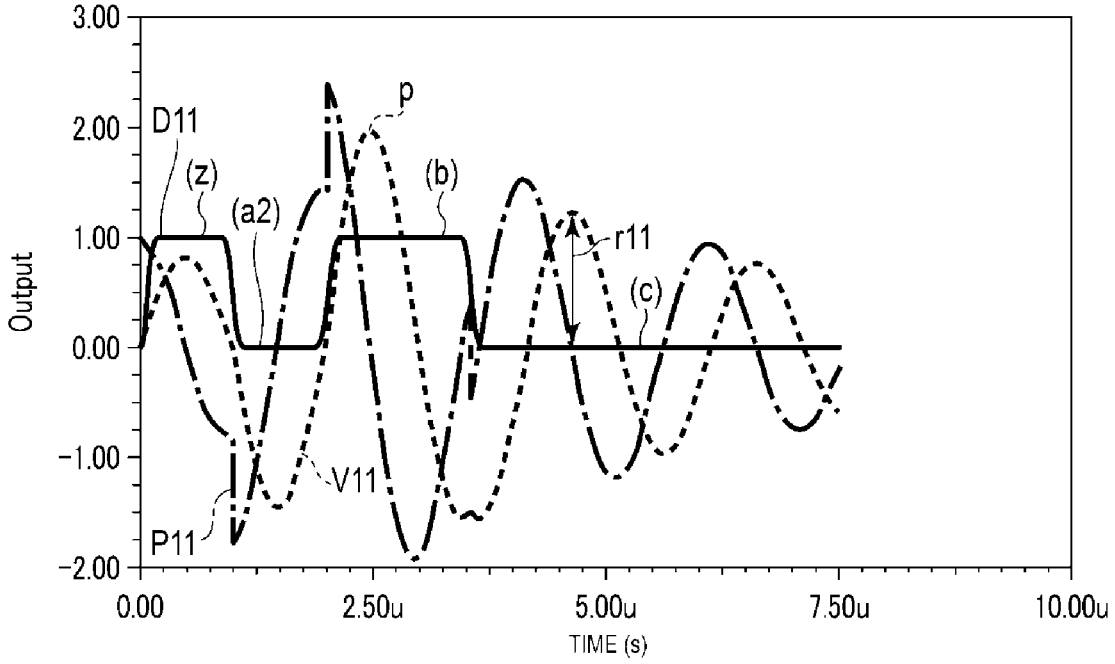
FIG. 16 is a diagram illustrating a driving waveform related to an eleventh analysis model and temporal changes in a nozzle flow rate and a nozzle pressure when the driving waveform is applied.

A driving waveform according to the fourth embodiment will be described with reference to FIG. 16. D11 in FIG. 16 indicates an example of a driving waveform which the head driver 100 applies to the actuator when ink equivalent to one droplet is ejected from the nozzle 25. FIG. 16 is a diagram related to an eleventh analysis model to be described below and obtained through numeric analysis.

The driving waveform according to the fourth embodiment is, for example, a waveform in which the potential varies in order of a positive potential (z), a zero potential (a2), a positive potential (b), and a zero potential (c), as indicated by D11 in FIG. 16. That is, for the driving waveform according to the fourth embodiment, the positive potential (z) and the zero potential (a2) are applied instead of the negative potential (a) in the driving waveform according to the first embodiment.

The positive potential (z) is an auxiliary pulse for causing the subsequently continuing zero potential (a2) to have the same effect as the negative potential (a). That is, when the pressure chamber 51 is contracted by the positive potential (z) and the zero potential (a2) is subsequently set, the volume of the pressure chamber at the zero potential (a2) is in a further expanded state than at the positive potential (z). Therefore, the zero potential (a2) continuing from the positive potential (z) has the same effect as the negative potential (a). From the viewpoint of the above description, the zero potential (a2) is an example of the first expansion pulse.

The application time of the positive potential (z) is preferably 1 AL. That is, the application time of the positive potential (z) is preferably a half time of the ink-inherent oscillation period of the ink chamber 19.

The application time of the zero potential (a2) is preferably 1 AL as in the negative potential (a) of the driving waveform according to the first embodiment.

In accordance with the forgoing conditions, the ink is efficiently ejected.

The application time of the positive potential (b) according to the fourth embodiment is the same as that of the first embodiment.

That is, the application of the positive potential (b) according to the fourth embodiment preferably ends when 3 AL or more passes from start of the application of the positive potential (z) and before 4 AL passes. The application of the positive potential (b) more preferably ends when 3 AL or more passes from the start of the application of the positive potential (z) and before 3.6 AL passes. The application of the positive potential (b) further more preferably ends when 3.5 AL passes from the start of the application of the positive potential (z).

The application of the positive potential (b) according to the fourth embodiment preferably ends when the nozzle flow rate is a negative value.

As in the first embodiment, the inkjet recording apparatus 1 can suppress occurrence of a satellite droplet by applying the driving waveform according to the fourth embodiment as in the first embodiment.

Hereinafter, the driving waveform according to the fourth embodiment will be described with reference to the eleventh analysis model. The eleventh analysis model is an analysis model based on numeric analysis as in the comparative analysis model and the first to tenth analysis models.

Eleventh Analysis Model

The driving waveform of the eleventh analysis model is illustrated in FIG. 16. FIG. 16 illustrates a driving waveform D11 related to the eleventh analysis model. FIG. 16 illustrates temporal changes in a nozzle flow rate V11 and a nozzle pressure P11 when the driving waveform D11 is applied.

For the driving waveform D11, after the positive potential (z) is applied for 1 AL, the zero potential (a2) is applied for 1 AL. Thereafter, the positive potential (b) is applied for a time shorter than 2 AL.

Even in the eleventh analysis model, a change such as the abrupt suppression of the nozzle flow rate V11 at the time of ending the application of the positive potential (b) does not occur and a sufficient residual amplitude r11 remains. Accordingly, as in the fourth embodiment, it can be understood that the same effect as that of the first embodiment can be obtained even when the positive potential (z) and the zero potential (a2) are applied instead of the negative potential (a).

The first to fourth embodiments can also be modified as follows.

The driving waveforms according to the first and second embodiments are waveforms in which the positive potential (b) is applied immediately after the negative potential (a). However, the driving waveforms may be waveforms in which a potential other than a zero potential or the like occurs for a given time without applying the positive potential (b) immediately after the end of the application of the negative potential (a).

In the first to fourth embodiments, when the potential of the driving signal is positive, the pressure chamber 51 is contracted. When the potential of the driving signal is negative, the pressure chamber 51 is expanded. However, when the potential of the driving signal is negative, the pressure chamber 51 may be contracted. When the potential of the driving signal is positive, the pressure chamber 51 may be expanded.

In addition to the foregoing example embodiments, the inkjet head 10 may have, for example, a structure in which ink is ejected by deforming an oscillation plate through static electricity or a structure in which ink is ejected from the nozzles using heat energy of a heater or the like. In this case, the oscillation plate, the heater, or the like serves as an actuator that provides pressure oscillation to the inside of the pressure chamber 51. The inkjet recording apparatus 1 according to the example embodiments described above is an inkjet printer that forms a 2-dimensional image on the recording medium S using ink. However, the inkjet recording apparatus according to the embodiments is not limited thereto. It should be noted that the particular example embodiments described above are just some possible examples of an inkjet recording apparatus according to the present disclosure and do not limit the possible configurations, specifications, or the like of inkjet recording apparatuses according to the present disclosure. The inkjet recording apparatus may be, for example, a 3D printer, an industrial manufacturing machine, or a medical machine. When the inkjet recording apparatus according to the present disclosure is a 3D printer, the inkjet recording apparatus forms, for example, a 3-dimensional object by ejecting a substance which becomes a raw material or a binder or the like for hardening the raw material from an inkjet head.

The inkjet recording apparatus 1 according to the example embodiments described above includes four liquid ejectors 2 and color of the ink I used by each of the liquid ejectors 2 is cyan, magenta, yellow, and black. However, the number of liquid ejectors 2 included in the inkjet recording apparatus is not limited to 4 and may not be other numbers. The color and characteristics of the ink I used by each liquid ejector 2 are not limited.

The liquid ejector 2 can also eject transparent glossy ink, ink coloring at the time of radiating infrared light or violet light, or other special ink. Further, the liquid ejector 2 may eject a liquid other than ink. The liquid ejected by the liquid ejector 2 may be a dispersing liquid such as a suspension. Examples of the liquid other than ink ejected by the liquid ejector 2 include, for example, a liquid that contains conductive particles for forming a wiring pattern of a printed wiring substrate, a liquid that contains cells for artificially forming a tissue, an organ, or the like, a binder such as an adhesive, wax, or a liquid-shaped resin.

While certain embodiments have been described, these embodiments have been presented by way of example only, and are not intended to limit the scope of the inventions. Indeed, the novel embodiments described herein may be embodied in a variety of other forms. Furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A driving device, comprising:

a head driver configured to:

generate and apply a driving signal to an actuator for ejecting a liquid from a pressure chamber connected to a nozzle, the driving signal including a contraction pulse, the contraction pulse causing the actuator to contract a volume of the pressure chamber; and end application of the contraction pulse when a flow rate of the liquid from the nozzle has a negative value in a liquid ejection direction from the nozzle, wherein the driving signal includes a first expansion pulse before the contraction pulse, the first expansion pulse for causing the actuator to expand the volume of the pressure chamber, the driving signal includes a second expansion pulse after the contraction pulse, the second expansion pulse for causing the actuator to expand the volume of the pressure chamber, the head driver starts application of the second expansion pulse when the flow rate of the liquid from the nozzle has a value greater than or equal to zero along the liquid ejection direction, and the head driver starts the application of the second expansion pulse before the flow rate of the liquid from the nozzle in the liquid ejection direction peaks and begins to slow, and ends the application of the second expansion pulse after the flow rate of the liquid from the nozzle would have peaked in the absence of the application of the second expansion pulse.

2. The driving device according to claim 1, wherein the pressure chamber is fluidly connected to an ink chamber, and a pulse length of the first expansion pulse is equal to a half time of an inherent oscillation period of a liquid in the ink chamber.

3. The driving device according to claim 2, wherein a pulse length of the contraction pulse is greater than the half time of the inherent oscillation period of the liquid and less than the inherent oscillation period of the liquid.

4. The driving device according to claim 1, wherein the second expansion pulse is applied after a length of time from a start of the application of the first expansion pulse has passed, the length of time being between one and half times and two times the inherent oscillation period of the liquid.

5. An inkjet recording apparatus, comprising:

a nozzle;

a pressure chamber connected to the nozzle;

an actuator configured to change a pressure of the pressure chamber; and a head driver configured to:

generate and apply a driving signal to an actuator for ejecting a liquid from a pressure chamber connected to a nozzle, the driving signal including a contraction pulse, the contraction pulse causing the actuator to contract a volume of the pressure chamber; and end application of the contraction pulse when a flow rate of the liquid from the nozzle has a negative value in a liquid ejection direction from the nozzle, wherein the driving signal includes a first expansion pulse before the contraction pulse, the first expansion pulse for causing the actuator to expand the volume of the pressure chamber, the driving signal includes a second expansion pulse after the contraction pulse, the second expansion pulse for causing the actuator to expand the volume of the pressure chamber, the head driver starts application of the second expansion pulse when the flow rate of the liquid from the nozzle has a value greater than or equal to zero along the liquid ejection direction, and the head driver starts the application of the second expansion pulse before the flow rate of the liquid from the nozzle in the liquid ejection direction peaks and begins to slow, and ends the application of the second expansion pulse after the flow rate of the liquid from the nozzle would have peaked in the absence of the application of the second expansion pulse.

6. The inkjet recording apparatus according to claim 5, further comprising:

an ink chamber fluidly connected to the pressure chamber, wherein a pulse length of the first expansion pulse is equal to a half time of an inherent oscillation period of a liquid in the ink chamber.

7. The inkjet recording apparatus according to claim 6, wherein a pulse length of the contraction pulse is greater than the half time of the inherent oscillation period of the liquid and less than the inherent oscillation period of the liquid.

8. The inkjet recording apparatus according to claim 5, wherein the second expansion pulse is applied after a length of time from a start of the application of the first expansion pulse has passed, the length of time being between one and half times and two times the inherent oscillation period of the liquid.

9. An inkjet head driving method, comprising:

applying a contraction pulse to an actuator for causing the actuator to contract a volume of a pressure chamber connected to a nozzle and ejecting a liquid from the pressure chamber;

ending application of the contraction pulse when a flow rate of the liquid from the nozzle has a negative value in a liquid ejection direction from the nozzle;

applying a first expansion pulse to the actuator before the contraction pulse for causing the actuator to expand the volume of the pressure chamber; and applying a second expansion pulse to the actuator after the contraction pulse for causing the actuator to expand the volume of the pressure chamber, when the flow rate of the liquid from the nozzle has a value greater than or equal to zero along the liquid ejection direction, wherein the application of the second expansion pulse starts before the flow rate of the liquid from the nozzle in the liquid ejection direction peaks and begins to slow, and ends after the flow rate of the liquid from the nozzle would have peaked in the absence of the application of the second expansion pulse.

10. The inkjet head driving method according to claim 9, further comprising:

supplying a liquid from an ink chamber to the pressure chamber, wherein a pulse length of the first expansion pulse is equal to a half time of an inherent oscillation period of the liquid in the ink chamber.

11. The inkjet head driving method according to claim 10, wherein a pulse length of the contraction pulse is greater than the half time of the inherent oscillation period of the liquid and less than the inherent oscillation period of the liquid.

* * * * *